US008191656B2

(12) United States Patent
Dourfaye et al.

(10) Patent No.: US 8,191,656 B2
(45) Date of Patent: Jun. 5, 2012

(54) AUTO ADAPTABLE CUTTING STRUCTURE

(75) Inventors: Alfazazi Dourfaye, Paris (FR); Bruno Cuillier, Pau (FR)

(73) Assignee: Varel International, Ind., L.P., Carrollton, TX (US)

( * ) Notice: Subject to any disclaimer, the term of this patent is extended or adjusted under 35 U.S.C. 154(b) by 0 days.

(21) Appl. No.: 12/794,640

(22) Filed: Jun. 4, 2010

(65) Prior Publication Data

US 2010/0243334 A1 Sep. 30, 2010

Related U.S. Application Data

(60) Division of application No. 12/171,070, filed on Jul. 10, 2008, now abandoned, and a continuation-in-part of application No. 11/643,718, filed on Dec. 20, 2006, now abandoned.

(60) Provisional application No. 60/949,419, filed on Jul. 12, 2007, provisional application No. 60/751,835, filed on Dec. 20, 2005.

(51) Int. Cl.
*E21B 10/36* (2006.01)

(52) U.S. Cl. ..... 175/428; 175/430

(58) Field of Classification Search ..... 175/413, 175/420.1, 426, 428, 430, 432; 51/307
See application file for complete search history.

(56) References Cited

U.S. PATENT DOCUMENTS

| | | | |
|---|---|---|---|
| 4,538,690 | A | 9/1985 | Short, Jr. |
| 4,558,753 | A | 12/1985 | Barr |
| 4,593,777 | A | 6/1986 | Barr |
| 4,629,373 | A | 12/1986 | Hall |
| 4,679,639 | A | 7/1987 | Barr et al. |
| 4,784,023 | A | 11/1988 | Dennis |
| 5,078,219 | A | 1/1992 | Morrell et al. |
| 5,332,051 | A | 7/1994 | Knowlton |
| 5,486,137 | A | 1/1996 | Flood et al. |
| 5,871,060 | A | 2/1999 | Jensen et al. |
| 5,924,501 | A | 7/1999 | Tibbitts |
| 6,550,556 | B2 | 4/2003 | Middlemiss et al. |
| 6,571,891 | B1 | 6/2003 | Smith et al. |
| 2005/0247492 | A1 | 11/2005 | Shen et al. |
| 2005/0269139 | A1 | 12/2005 | Shen et al. |

FOREIGN PATENT DOCUMENTS

| | | | |
|---|---|---|---|
| EP | 0841463 | * | 3/2004 |
| JP | S59-219500 | | 12/1984 |

* cited by examiner

*Primary Examiner* — Cathleen Hutchins
(74) *Attorney, Agent, or Firm* — Andre M. Szuwalski; Gardere Wynne Sewell LLP

(57) ABSTRACT

A cutter is configured with a diamond table made from a thin hard facing material layer of polycrystalline diamond bonded to a backing layer made from cemented tungsten carbide. The face of the diamond table includes a concavity formed with a curved shape wherein at least a portion of the face in a center of the cutter is recessed with respect to at least some portion of the face about the perimeter of the cutter. This concave curved shape is formed in the diamond table itself such that the diamond table has a varying thickness depending on the implemented concavity.

42 Claims, 8 Drawing Sheets

AUTO ADAPTABLE CUTTING STRUCTURE

PRIORITY CLAIMS

The present application is a divisional of United States application for patent Ser. No. 12/171,070 filed Jul. 10, 2008 (the '070 application) which claims the benefit of U.S. Provisional Application for Patent 60/949,419 filed Jul. 12, 2007 entitled "Auto Adaptable Cutting Structure", and the '070 application is a continuation-in-part of U.S. application for patent Ser. No. 11/643,718 filed Dec. 20, 2006, which claims the benefit of U.S. Provisional Application for Patent 60/751,835 filed Dec. 20, 2005, the disclosures of which are hereby incorporated by reference to the maximum extent allowable by law.

BACKGROUND

1. Technical Field

The present invention relates to earth boring bits, and more particularly to those having polycrystalline diamond compact (PDC) cutters.

2. Description of Related Art

Efficiently drilling rock of various hardness or in overbalanced formations has always been related to the amount of power (RPM×WOB) injected in the drilling system (RPM=revolutions per minute; WOB=weight on bit). A linear relationship between ROP (rate of penetration) and WOB has always been taken into consideration for PDC bit performance, and cutting structure efficiency ranking can be evaluated through an examination of MSE (mechanical specific energy). Generally, this brought about the usage of high forces in order to be efficient. Usage of high cutting forces, however, can cause problems like BHA (bottom hole assembly) buckling, deviation issues, and dynamic problems resulting at the end in an inefficient usage of the power input to the drilling system. In addition, the usage of these high forces can induce on the cutting element itself premature failures due to potential impacts of various magnitude or frequency and higher frictional heat resulting in a faster cutting element wear rate.

PDC cutters are typically formed from a mix of material subjected to high temperature and high pressure. A common trait of a PDC cutter is the use of a catalyst material during their formation. These cutters are known to have several different shapes and geometries.

A PDC cutter with improved durability uses an elliptical shape. These cutters have been marketed as "oval" cutters. These cutters have an elliptical form (with a major axis and a minor axis). An elliptical cutter has a better indentation action than a round cutter. Thus, these elliptical cutters generate a more concentrated crushed zone in the formation and deeper tensile cracks in the surrounding non-crushed zone.

A conventional PDC cutter is placed with the diamond table facing the direction of bit rotation. The edge of the cutter is pushed into the formation by the WOB. When an elliptical cutter is used, the small end of the cutter (in the direction of the major axis) is typically presented to the formation. This has the effect of presenting a "sharper" edge, which generates a higher point loading at a lower WOB versus a round cutter. By replacing a 13 mm round PDC cutter by a 19*13 mm elliptical PDC cutter, the diamond volume (density or radial diamond content) of the cutter remains the same, but the cutter exposure and axial diamond volume can be increased significantly.

There is a need in the art for a PDC cutter having a configuration of its cutting structure which increases drilling efficiency (presenting a lower MSE level). For example, there is a need for a specific cutter shape and configuration that requires less WOB than conventional cutters for a given ROP, thus lessening the wear rate (thermal and dynamic) and further resulting in a higher cutting efficiency which brings about a higher ROP and durability. This cutting structure could thus be considered to be "sharper" than that of the prior art. Additionally, there would be an advantage if this improved cutting structure presented better diamond table cooling and an easier evacuation of cutting chips during operation.

The following references are incorporated herein by reference: U.S. Pat. Nos. 4,538,690, 4,558,753, 4,593,777, 4,679,639, 4,784,023, 5,078,219, and 5,332,051; and U.S. Patent Application Publication Nos. 2005/0247492, 2005/0269139 and 2007/0235230.

SUMMARY

In an embodiment, a cutter comprises: a backing layer; and a thin hard facing material layer bonded to the backing layer, wherein a thickness of the thin hard facing material layer varies along at least a part of a length of the cutter to define a face of the cutter having a curved surface. The curved surface of the cutter face may present a spherical, paraboloid or ovaloid surface.

In an embodiment, a cutter comprises: a backing layer; and a thin hard facing material layer bonded to the backing layer, wherein a thickness of the thin hard facing material layer varies to define a concave front surface of the cutter. The concave surface may present a spherical, paraboloid or ovaloid surface.

In an embodiment, a cutter comprises: a backing layer; and a thin hard facing material layer bonded to the backing layer, wherein a thickness of the thin hard facing material layer varies to define a paraboloid front surface concavity for the cutter.

In an embodiment, a cutter comprises: a cylindrical backing layer having a front surface; and a thin hard facing material layer bonded to the front surface of the backing layer, the thin hard facing material layer having a front surface including a paraboloid concavity.

In an embodiment, a cutter has a backing layer with an upper surface and a thin hard facing material layer bonded to the upper surface of the backing layer and defining a face of the cutter. The thickness of the thin hard facing material layer varies across the face of the cutter to define a concave cutter face, such that the thickness is thinnest at a central region of the face of the cutter and thickest at a peripheral edge location of the face of the cutter. The cutter has one of a round or elliptical shape.

In an embodiment, a cutter has a backing layer with an upper surface and a thin hard facing material layer bonded to the upper surface of the backing layer and defining a face of the cutter. The cutter has one of a half-round or half-elliptical shape defining a curved peripheral edge and a straight peripheral edge. The thickness of the thin hard facing material layer varies across the face of the cutter to define a concave cutter face, such that the thickness is thinnest at about a central region along the straight peripheral edge of the face of the cutter and thickest at a peripheral edge location on the curved peripheral edge of the face of the cutter.

In an embodiment, a cutter has a backing layer with an upper surface and a thin hard facing material layer bonded to the upper surface of the backing layer and defining a face of the cutter. The cutter has one of a round or elliptical shape defining a curved peripheral edge. The face of the cutter is bisected along a line into a first half-region and a second half-region. The thickness of the thin hard facing material layer in the first half-region varies across the face of the cutter to define a concave cutter face, so that the thickness is thinnest at about a central portion of the first half-region and thickest at a peripheral edge location on the curved peripheral edge of the face of the cutter and furthermore thickest along the bisecting line.

In an embodiment, a drill bit comprises: a bit matrix including a cutter pocket formed therein; a cutter, comprising: a backing layer which is attached by brazing to the cutter pocket; and a thin hard facing material layer bonded to the backing layer, wherein a thickness of the thin hard facing material layer is not constant so as to define curved cutter surface presenting a counter angle. The curved surface may present a spherical, paraboloid or ovaloid surface.

In an embodiment, a drill bit comprises: a bit matrix including a cutter pocket formed therein; a cutter, comprising: a cylindrical backing layer which is attached by brazing to the cutter pocket and which defines a relief angle; and a thin hard facing material layer bonded to the front surface of the backing layer, the thin hard facing material layer having a front surface including a paraboloid concavity which defines both a counter angle and back rake angle; wherein the back rake angle and relief angle are not equal to each other.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 1:
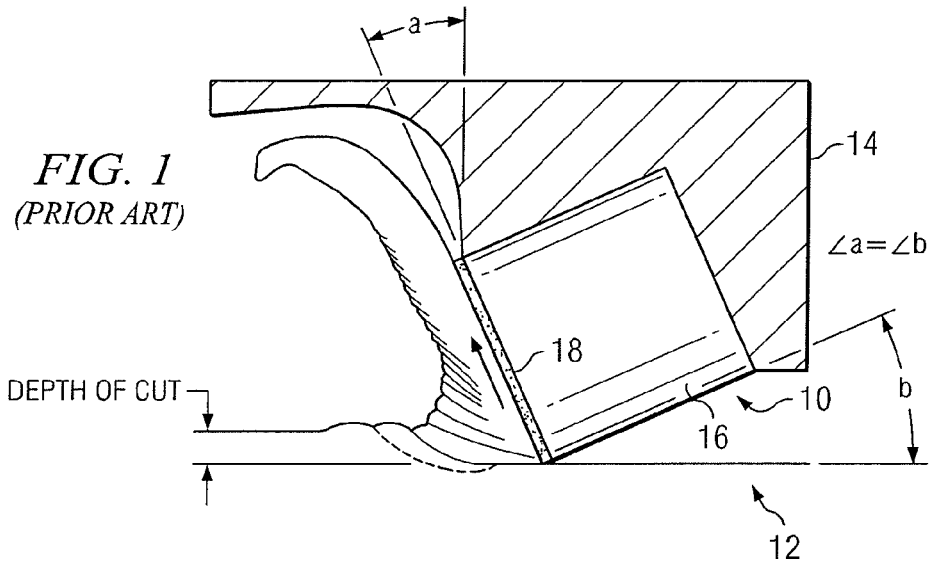
FIG. 1 (PRIOR ART)
FIG. 1 illustrates a side view of a conventional cylindrical PDC cutter configuration engaging a formation.

Reference is now made to FIG. 1 which illustrates a side view of a conventional cylindrical PDC cutter 10 configuration engaging a formation 12. The cutter 10 is mounted to a bit matrix 14, for example by being brazed into a cutter pocket formed on a blade of the bit, and configured with a negative back rake at an angle a. It will further be noted that the relief angle b for the cutter in this configuration is equal to the back rake angle a. A PDC cutter set with a negative back rake, as shown in prior art FIG. 1, will fracture the rock of the formation 12 by compressing the rock until tensile stress failure occurs. The cutter tends to compress the cutting chips and collapse tensile cracks in the formation which may reinforce the strength of the rock under the front face of the cutter. Thus, the cutting forces increase, particularly in a direction normal to the surface of the cutter. This compression effect increases with increases in negative back rake angle. It will further be noted that a cylindrical cutter 10 of the shape shown in FIG. 1 cannot be used in low back rack angle a configurations because of the corresponding low relief angle b and the risk of rubbing on the cutting groove in the formation 12.

The cutter 10 of FIG. 1 is configured with a diamond table 18 comprising a thin hard facing material of substantially constant thickness bonded to a backing layer 16 having a cylindrical configuration. The surface of the diamond table 18 is essentially planar. Conventionally, the backing layer 16 is made from cemented tungsten carbide, and the constant thickness diamond table 18 layer is a layer of polycrystalline diamond (which may, in certain situations, be leached in manner known to those skilled in the art).

Figure 2:
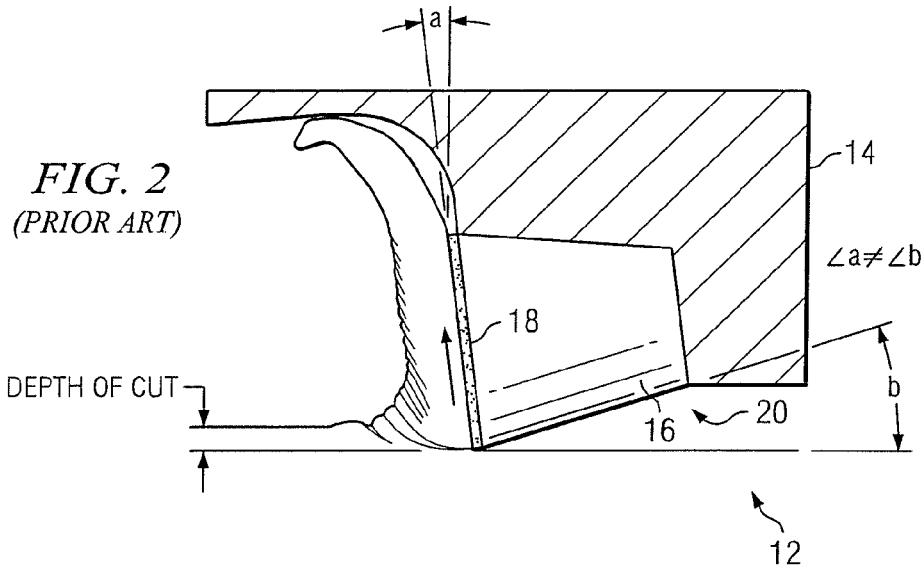
FIG. 2 (PRIOR ART)
FIG. 2 illustrates a side view of a conventional conical PDC cutter configuration engaging a formation.

Reference is now made to FIG. 2 which illustrates a side view of a conventional conical PDC cutter 20 configuration engaging a formation 12. The cutter 20 is configured with a small back rake at an angle a. It will further be noted that the relief angle b for the conical cutter in this configuration is not equal to the back rake angle a due to the conical geometry of the cutter 20. Cutters having low back rake angles are more aggressive and less loading. However, the conical cutters still have a cylindrical diamond table and a small tungsten carbide substrate which limits the use of low back rake angles.

The cutter 20 of FIG. 2 is configured with a diamond table 18 comprising a thin hard facing material of substantially constant thickness bonded to a backing layer 16 having a conical configuration. Again, the front surface of the diamond table 18 is essentially planar. Conventionally, the backing layer 16 is made from cemented tungsten carbide, and the constant thickness diamond table 18 layer is a layer of polycrystalline diamond (which may, in certain situations, be leached in manner known to those skilled in the art).

When the effective back rake angle for a cutter is, however, positive, tensile cracks are expanded. Cutting force normal to the face of the cutter is reduced. Additionally, the compression effect due to normal stress is lower (or nil). Advantageously, cutting chips are removed under the action of the propagation of tensile cracks. Cutting force is constant as a function of rock tensile strength. It is accordingly preferable with respect to some formations to use a cutter with a positive back rake angle.

Figure 3:
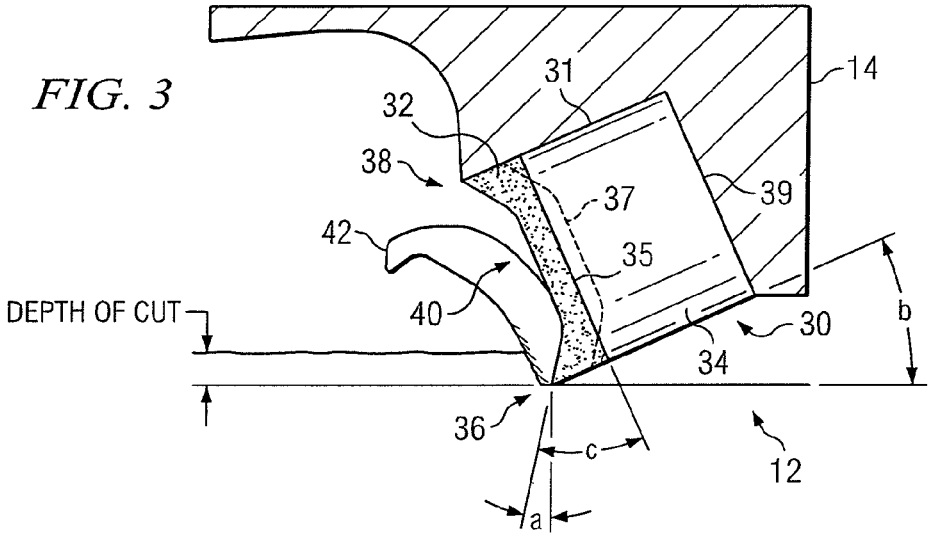
FIG. 3 illustrates a side view of a PDC cutter with a concave surface configuration engaging a formation.

Reference is now made to FIG. 3 which illustrates a side view of a PDC cutter 30 with a concave (or paraboloid) face configuration engaging a formation 12. The cutter 30 is mounted to bit matrix 14, for example by being brazed into a cutter pocket formed on a blade of the bit. In this implementation, which can represent generally either a round or an elliptical cutter, the face of the cutter 30 includes a concavity, for example having a spherical, paraboloid or ovaloid shape. In other words, a portion of the face of the diamond table, in this instance at the center, is recessed with respect to at least some portion of the perimeter of the diamond table face. The effect of the concavity in the face (and specifically for the diamond table itself) is to allow for the use of a cylindrical substrate cutter configuration (like that shown in FIG. 1) while supporting low back rake angles a. Still further, this configuration potentially and beneficially enables the use of positive back rake angles a (depending on cutter pocket orientation) while still using a cylindrical substrate cutter configuration brazed into a pocket on the bit matrix with a high relief angle b.

It will be noted that when a concavity is present in the cutter face, the back rake angle a changes as a function of depth of cut (and rate of penetration). The illustrated back rake angle a represents the angle when the cutter is substantially new and/or when the depth of cut is shallow. As the end 36 of the diamond table wears, or penetration increases, the back rake angle changes due to the shape of the concavity on the face. Thus, the relationship between the back rake angle and the relief angle that is present and fixed in the FIG. 1 implementation with a cylindrical substrate (back rake angle=relief angle), and further which is present and fixed in connection with a conical substrate (relief angle=back rake angle+½ cone angle), is no longer valid with respect to the cutter having the configuration generally shown in FIG. 3.

The configuration of FIG. 3 with a concavity in the cutter face disconnects relief angle from back rake angle and provides a back rake angle that varies with diamond table wear and/or bit penetration (depth of cut). By selectively choosing the geometric properties of the concavity, a curved shape may be presented which can maintain an effective back rake (for example, even positive) over a wide range of depth of cut. It will be noted, however, that as depth of cut increases, the effective back rake angle changes and moves from positive to negative. At this point, issues with respect to increased normal stress and increases cutting forces due to compressive effect become more of an issue. Thus, the evolution of cutting forces with respect to a cutter generally of the configuration shown in FIG. 3 can be divided into three phases: a) an indentation phase where cutting forces increase; b) a tensile phase where cutting forces remain constant; c) and an increased back rake angle phase where forces increase due to increased depth of cut (the forces increasing towards a value corresponding to an effective back rake angle equal to a pocket back rake angle).

The cutter 30 of FIG. 3 is configured with a diamond table 32 comprising a thin hard facing material bonded to a backing layer 34 having a cylindrical configuration (the concave curved face obviating the need to consider use of a conical configuration as in FIG. 2). Conventionally, the backing layer 34 is made from cemented tungsten carbide, and the diamond table 32 layer is a layer of polycrystalline diamond (which may, in certain situations, be leached in manner known to those skilled in the art). The cylindrical surface 31 of the backing layer 34 is brazed within a pocket formed in the bit matrix 14. Through effective selection of the geometric configuration of the pocket, a desired back rake orientation can be provided for the installed cutter 30.

In one implementation, the diamond table 32 layer of FIG. 3 has a varying thickness which depends on (or is a function of) the geometry of the implemented concavity. This is unlike the diamond table 18 layer used in FIGS. 1 and 2 which has a substantially constant thickness. Thus, in the exemplary implementation of FIG. 3, the diamond table 32 layer is thicker towards a perimeter of the cutter 30 at opposed ends 36 and 38 and thinner towards a center 40 of the cutter 30. The end 36 is shown positioned in a direction for engaging the formation to be drilled. The face of the diamond table 32 layer may be said to be generally defined by a curve (for example, of a parabolic shape). The interface 35 between the rear of the diamond table 32 layer and the front of the backing layer 34 in this implementation is typically, but not exclusively, planar and parallel to a rear surface 39 of the backing layer 34. The thickness of the diamond table, however, is taken without regard to any thickness variations due to a non-planar (or non-smooth surface) interface between the diamond layer and carbide substrate. The top surface of the carbide substrate at the diamond table interface may include grooves, bumps, wedges, raised/lowered lands, etc., as taught by U.S. Pat. No. 4,784,023 and U.S. Patent Application Publication No. 2007/0235230. With such features being present, the interface surface against which thicknesses are measured may be defined as a hypothetical smooth or flat surface, for example defined as a mean between a rough bottom surface of the diamond and a corresponding rough top surface of the carbide substrate.

In another implementation, the diamond table 32 layer of FIG. 3 has a substantially constant thickness like the diamond table 18 layer used in FIGS. 1 and 2. The concave curve face of the cutter is provided by varying the thickness of the backing layer 34 depending on (or as a function of) the desired geometry of the implemented concavity. The interface 37 (see, dotted line) between the rear of the diamond table 32 layer and the front of the backing layer 34 in this implementation is non-planar and presents a certain desired concavity to be mimicked by the face of the cutter. Thus, in this alternative implementation of FIG. 3, the backing layer 34 is thicker towards a perimeter of the cutter 30 at opposed ends 36 and 38 and thinner towards a center 40 of the cutter 30. With a substantially constant thickness, the face of the diamond table 32 layer may still be said to be generally defined by a curved concavity corresponding to that presented by the backing layer 34 at the interface 37.

Still further, in yet another implementation, the interface 37 may be used in connection with a diamond table 32 layer having a varying thickness. With this configuration, the concave curve shape of the face of the diamond table 32 layer depends on (or is a function of) the combination of the varying thickness of the diamond table layer and the geometry of the implemented concavity on the front surface of the backing layer 34.

The exemplary implementation of FIG. 3 shows a cutter 30 with a concave curved cutter face defined generally by three portions or segments (comprising two curvilinear segments generally associated with the ends 36 and 38 and a middle curvilinear segment associated with the center 40). The concave curved shape cutter face in this implementation, with different radii of curvature for two or more of the surfaces in the concavity, thus does not present a continuously curved shape (or concave geometry possessing a smooth curved surface defined by a circle or sphere, or a parabola or paraboloid, for example). It will be understood, however, and will be further illustrated and described herein, that either a segmented curve or continuous curve shape for the concavity formed in the cutter face is within embodiments of the present invention.

With respect to drilling in plastic formations, cutters having a positive back rake angle fracture the rock of the formation by shearing. Since rock tensile strength is lower than compressive strength, cutters set with a positive back rake angle generate lower drag and normal forces than cutters set with a negative back rake angle. The concavity in the cutter face of FIG. 3 defines a curve which supports use of a positive back rake (for example, as illustrated) thus enabling a shearing rock destruction mode. Additionally, the concave curved shape of the cutter face generates smaller cutting chips 42 in a plastic formation. This is because the cutting chips break off from the formation before reaching a critical size thanks to the concave curvature of the face of the diamond table 32. The generation of smaller chips 42 serves to accelerate the evacuation of cuttings and avoids balling (especially in connection with drilling in a plastic formation). As a consequence, the cutter configuration generally shown in FIG. 3, and further described with other implementations herein, provides for better bit cleaning.

With respect to drilling in hard formations, it is typical to experience a high level of vibration due to the cyclic load of the cutter and the failure mode of these rocks under compression solicitation. The loading fluctuation creates a variety of disadvantages such as premature bit wear and a reduction of ROP due to frictional energy dissipation. Thus, drillers will increase the WOB to maintain the ROP, but this consequently will generate drill string bending and maintaining directional control will be an issue. That aspect is more critical in vertical drilling. The use of a concave curved cutter face as shown in FIG. 3, and further described with other implementations herein, will suppress or reduce drastically that phenomenon.

With respect to motor drilling applications, the most common problem faced while drilling with a down hole motor is stalling of the motor due to high torque loads being created at the cutting face of the bit. The use of a concave curved cutter face as shown in FIG. 3, and further described with other implementations herein, generates lower torque (a function of the drag force or cutting force) compared to conventional planar cutter configurations like those shown in FIGS. 1 and 2.

Mechanical specific energy (MSE) presents a commonly used criteria for assessing drill bit efficiency. This measurement is composed with the torque (function of the drag force) and WOB (function of the normal force) at the bit and both of these parameters are drastically lower while using a concave curved cutter face as shown in FIG. 3, and further described with other implementations herein. Use of such a cutter boosts bit efficiency and helps to tackle some challenging applications where energy transmission is an issue. A drill bit set with paraboloid concavity cutters are more steerable due to a higher aggressiveness of the cutters and high dog leg severity (DLS) or rate of directional change can be reached with a less powerful motor.

The concave curved face PDC cutter implemented in FIG. 3, and further described with other implementations herein, can have either an elliptic or round face shape, as well as have other face shapes as desired. The concavity of the face means that the face of the diamond table of the cutter facing the formation is non-planar, and more specifically a spherical, paraboloid or ovoidal shape. Advantageously, this presents a sharper tip at a given depth of cut presented to the formation with a variation of the bit efficiency versus depth of cut. Cutting angles will vary at the cutter/rock interface. The geometry of the cutter further supports improved chip flow (cleaning) and improved diamond table cooling.

As an example, with a relief angle b equal to 20 degrees, and a counter angle c (for the face concavity) of 15 degrees, a cylindrical PDC cutter with a concave curved face can present a variable back rake angle a from 5 degrees to 20 degrees depending on depth of cut. The counter angle c is measured between a tangent line of the concave curve surface at the perimeter edge of the cutter and the flat back surface of the cylindrical substrate 34 (or parallel rear attaching surface of the diamond table 32).

As another example, with a relief angle b equal to 10 degrees, and a counter angle c (for the face concavity) of 15 degrees, a cylindrical PDC cutter with a concave curved face can present a variable back rake angle a from −5 degrees to 10 degrees depending on depth of cut.

Figure 4:
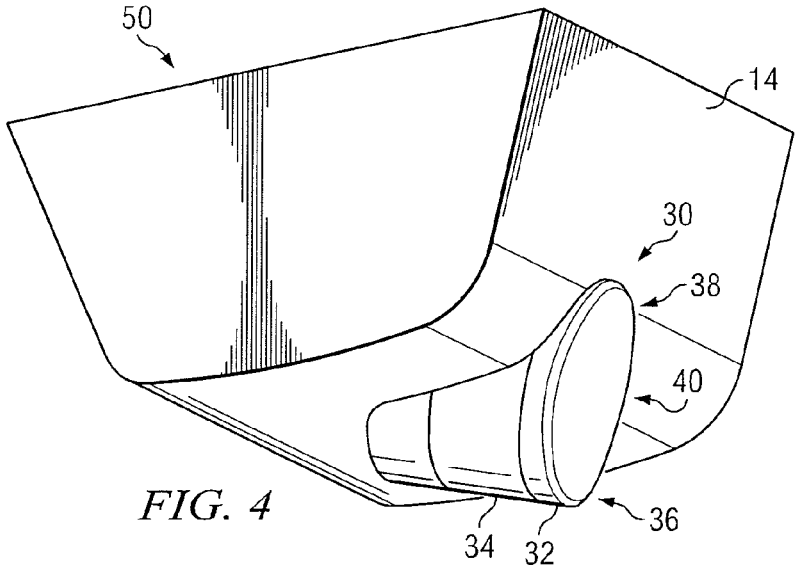
FIG. 4 illustrates a portion of a drill bit (such as a blade) to which an elliptical cutter having a concave shape cutter face has been mounted.
Figure 5A:
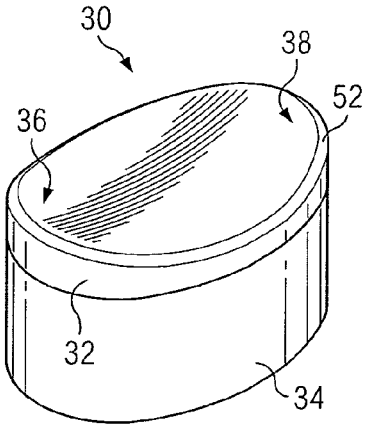
FIGS. 5A and 5B show a perspective view and side view, respectively, for the elliptical cutter having a concave shape cutter face used in FIG. 4.
Figure 5B:
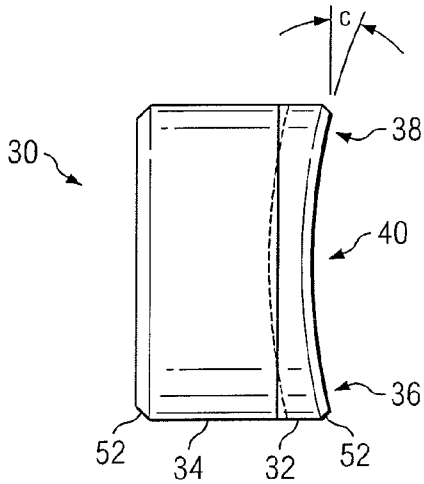

Reference is now made to FIG. 4 which illustrates a portion 50 of a drill bit (for example, that portion being on one of the blades of the drill bit) to which a cutter 30 having a concave curved cutter face has been mounted (for example, to the bit matrix 14 through brazing into a formed cutter pocket). The cutter 30 in FIG. 4 is, for example, an elliptical cutter having a major axis and a minor axis. The concavity present in the face of the cutter 30 is defined by a curved or parabolic shape oriented along the major axis extending from end 36 to end 38 to form a parabolic (or hyperbolic paraboloid) concavity. In a preferred but not exclusive implementation, the thickness of the diamond table 32 layer varies as a function of the concave shape cutter face. The diamond table 32 layer is thicker towards a perimeter of the cutter 30 at the opposed ends 36 and 38 (along the major axis) and thinner towards a center 40 of the cutter 30 (and along the minor axis). Still further, it will be noted, as distinct from the illustration in FIG. 3, that the concave cutter face in the implementation of FIG. 4 presents a continuous curve from end to end along and in the direction of the major axis. The cutter is installed with the major axis and end 36 oriented toward the formation to be drilled. Reference is also made to FIGS. 5A and 5B which show a perspective view and side view (along the major axis), respectively, for the elliptical cutter 30 used in FIG. 4. The cutter 30 further includes an optional chamfer 52 provided about the front perimeter edge of the diamond table 32 (not extending in depth to reach the substrate 34) as well an optional chamfer 52 at the rear perimeter edge of the substrate 34. The concavity on the face as defined by the curve presents a counter angle c in the direction of the major axis.

It will be understood that the cutter 30 shown mounted in FIG. 4 can have any one of a number of configurations. Examples of configurations for the cutter 30, in addition to that shown in FIGS. 4 and 5A-5B, are presented in FIGS. 6-20 which are discussed in more detail below. Any of these cutters 30 can be brazed into the bit structure of FIG. 4. Additionally, although varying thickness diamond tables are illustrated, it will be understood that configurations in accordance with the alternative implementations described in connection with FIG. 3 are equally applicable to each of the configurations of FIGS. 4-20.

Figure 6A:
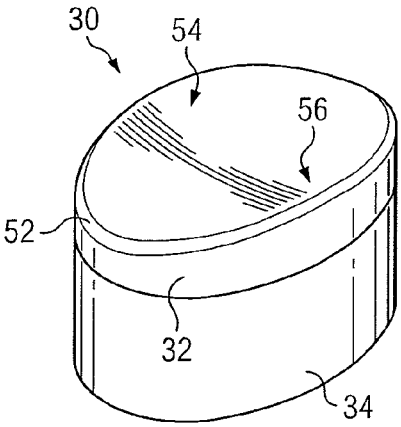
FIGS. 6A and 6B show a perspective view and side view, respectively, for an elliptical cutter having a concave shape cutter face.
Figure 6B:
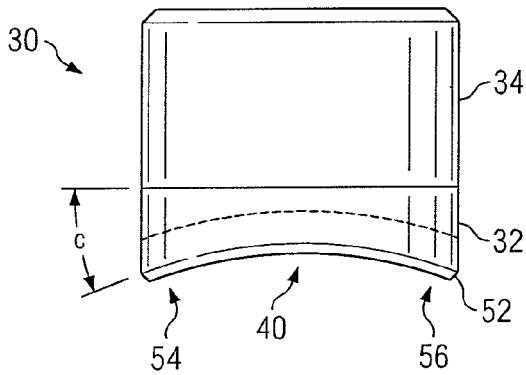

FIGS. 6A and 6B also illustrate an elliptical cutter having a major axis and a minor axis. The concavity present in the face of the cutter 30 is defined by a curved or parabolic shape oriented along the minor axis extending from end 54 to end 56 to form a parabolic (or hyperbolic paraboloid) concavity. The concave cutter face presents a continuous curve from end to end along the minor axis. In a preferred but not exclusive implementation, the thickness of the diamond table 32 layer varies as a function of the concave shape cutter face. In this elliptical cutter, as differentiated from that shown in FIGS. 5A-5B, the diamond table 32 layer is thicker towards a perimeter of the cutter 30 at the opposed ends 54 and 56 (along the minor axis) and thinner towards a center 40 of the cutter 20 (and along the major axis). The cutter 30 would likely be installed in the structure shown in FIG. 4 with its minor axis and end 54 oriented toward the formation to be drilled. The concavity on the face defined by the curve presents a counter angle c for the face concavity in the direction of the minor axis.

Figure 7A:
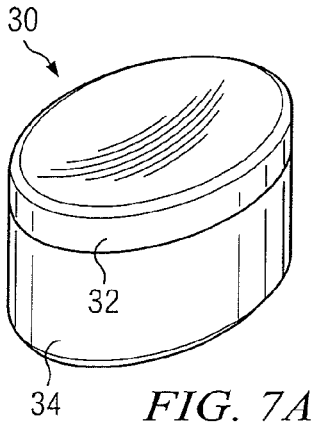
FIGS. 7A, 7B and 7C show a perspective view and two cross-sectional views, respectively, for an elliptical cutter having a concave shape cutter face.
Figure 7B:
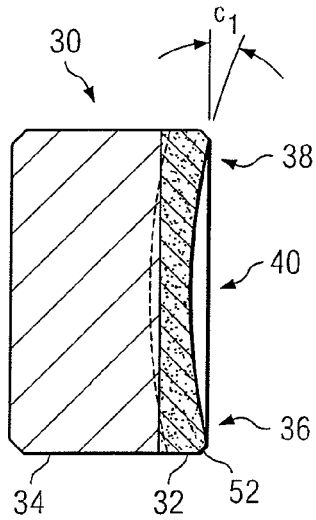
Figure 7C:
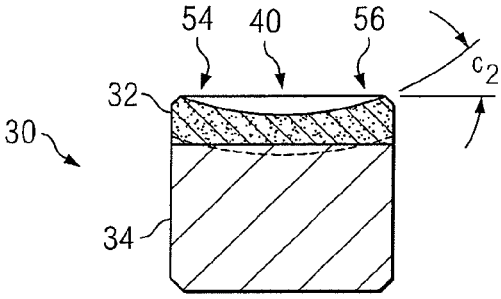

FIGS. 7A, 7B and 7C also illustrate an elliptical cutter having a major axis and a minor axis. FIGS. 7B and 7C are cross-sectional views taken along the major and minor axes, respectively, of the elliptical cutter. The concavity present on the face of the cutter 30 is defined by a curved or parabolic shape oriented along each of the major axis and minor axis which results in the formation of spherical, elliptical paraboloid or ovoidal concavity. The concave cutter face accordingly presents a continuous curve along any selected orientation from end to end across the face. In a preferred but not exclusive implementation, the thickness of the diamond table 32 layer varies as a function of the concave shape cutter face. In this elliptical cutter, the diamond table 32 layer is thicker towards a perimeter of the cutter 20 at all locations along and about that perimeter elliptical edge. Thus, the diamond table 32 is thicker towards a perimeter of the cutter 30 at the opposed ends 36 and 38 (along the major axis) as well as being thicker at the opposed ends 54 and 56 (along the minor axis), while being thinner towards a center 40 of the cutter 30. The cutter could be installed in the structure shown in FIG. 4 with either its minor axis (and ends 54/56) or its major axis (and ends 36/38) oriented toward the formation to be drilled. The concavity on the face presents a first counter angle $c_1$ in the direction of the major axis, and a second counter angle $c_2$ in the direction of the minor axis. These counter angles need not be equal to each other.

Figure 8A:
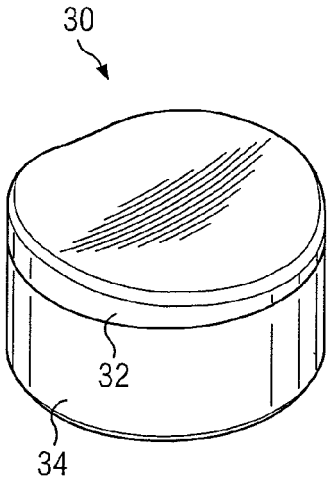
FIGS. 8A and 8B show a perspective view and side view, respectively, for a round cutter having a concave shape cutter face.
Figure 8B:
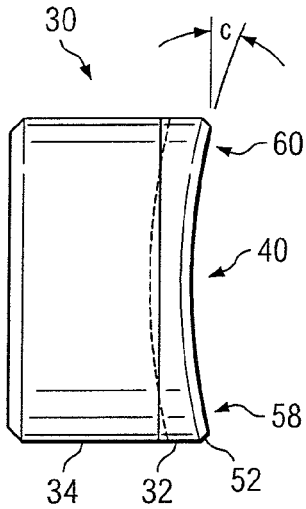

FIGS. 8A and 8B illustrate a round cutter having a first orientation axis. The concavity present on the face of the cutter 30 is defined by a curved or parabolic shape oriented along the first axis extending from end 58 to end 60 to form a parabolic (or hyperbolic paraboloid) concavity. The concave cutter face presents a continuous curve from end to end along the first axis. In a preferred but not exclusive implementation, the thickness of the diamond table 32 layer varies as a function of the concave shape cutter face. In this round cutter, the diamond table 32 layer is thicker towards a perimeter of the cutter 30 at the opposed ends 58 and 60 (along the first orientation axis) and thinner towards a center 40 of the cutter 30 (and along a second axis orthogonal to the first axis). The cutter is installed in the structure shown in FIG. 4 with its first orientation axis and end 58 oriented toward the formation to be drilled. The concavity on the face presents a counter angle c in the direction of the first axis.

Figure 9A:
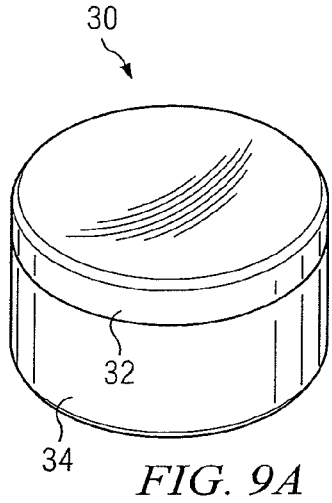
FIGS. 9A, 9B and 9C show a perspective view and two cross-sectional views, respectively, for a round cutter having a concave shape cutter face.
Figure 9B:
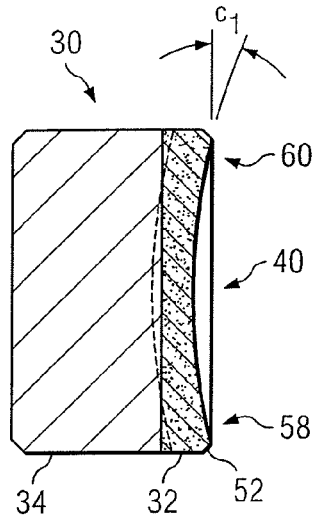
Figure 9C:
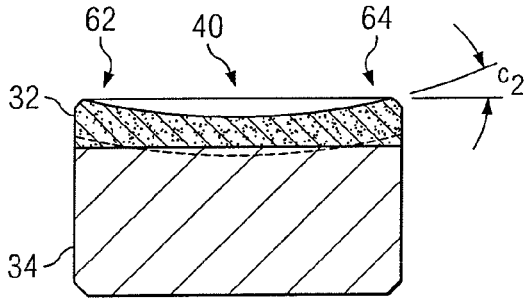

FIGS. 9A, 9B and 9C also illustrate a round cutter. FIGS. 9B and 9C are cross-sectional views taken along two orthogonal axes, respectively, of the round cutter. The concavity present on the face of the cutter 30 is defined by a curved or parabolic shape oriented along each of the two orthogonal axes which results in the formation of spherical, elliptical paraboloid or ovoidal concavity. The concave cutter face accordingly presents a continuous curve along any selected orientation from end to end across the face. In a preferred but not exclusive implementation, the thickness of the diamond table 32 layer varies as a function of the concave shape cutter face. In this round cutter, the diamond table 32 layer is thicker towards a perimeter of the cutter 30 at all locations along and about that perimeter edge. Thus, it is thicker towards a perimeter of the cutter 20 at the opposed ends 58 and 60 (along a first axis) as well as being thicker at the opposed ends 62 and 64 (along a second, orthogonal, axis), while being thinner towards a center 34 of the cutter 30. The cutter could be installed in the structure shown in FIG. 4 with any selected axis (or end or edge portion) oriented toward the formation to be drilled. The concavity on the face presents a first counter angle $c_1$ in the direction of the first axis, and a second counter angle $c_2$ in the direction of the second axis. These counter angles need not be equal to each other.

Figure 10A:
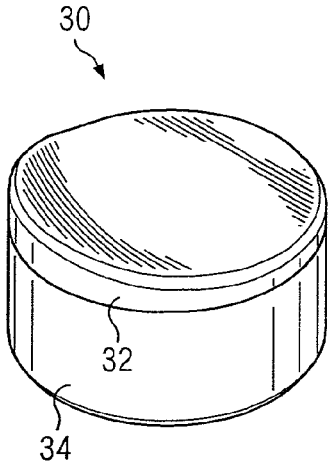
FIGS. 10A and 10B show a perspective view and side view, respectively, for a round cutter having a concave shape cutter face.
Figure 10B:
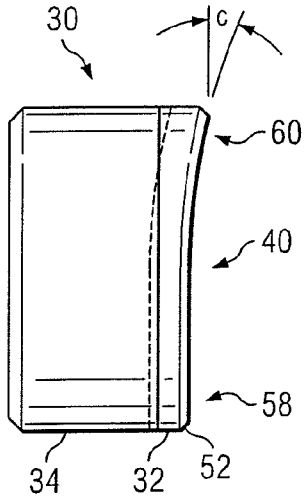

FIGS. 10A and 10B also illustrate a round cutter having a first orientation axis. The concavity present on the face of the cutter 30 is defined by a curved or parabolic shape oriented along the first axis extending from center 40 towards end 60 to form a parabolic (or hyperbolic paraboloid) concavity at that end and a planar surface at opposite end 58. The concave cutter face presents a continuous curve extending along the first axis from the flat surface associated with the second end 58 and center 40 and terminating at the first end 60. In a preferred but not exclusive implementation, the thickness of the diamond table 32 layer varies as a function of the concave shape cutter face. In this round cutter, the diamond table 32 layer is thicker towards a perimeter of the cutter 30 at only a first end 60 (along the first orientation axis) and thinner towards a center 40 and towards the second end 58 along the first orientation axis. More specifically, the diamond table 32 layer has a substantially constant thickness from the second end toward the center along the first axis. The thickness of the diamond table 32 layer then increases from the center 40 towards the first end 60 along the first orientation axis. The cutter is installed in the structure shown in FIG. 4 with its first orientation axis, and first end 60, oriented toward the formation to be drilled. The concavity on the face presents a counter angle c in the direction of the first axis.

Figure 11A:
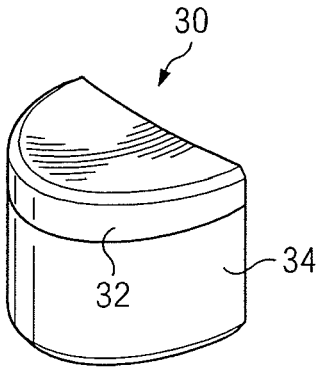
FIGS. 11A, 11B and 11C show a perspective view, a cross-sectional view and an end view, respectively, for a half-elliptical cutter having a concave shape cutter face.
Figure 11B:
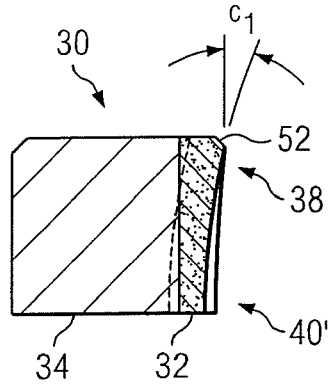
Figure 11C:
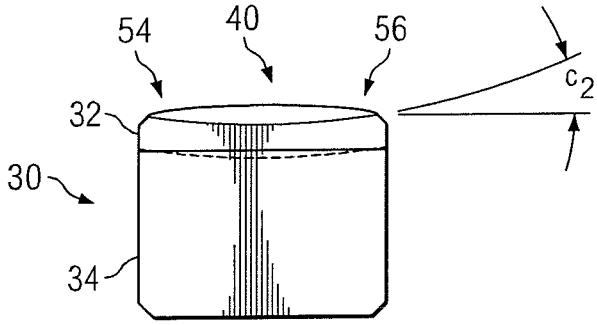

FIGS. 11A, 11B and 11C illustrate a half-elliptical cutter having a major axis and a minor axis. FIG. 11B is a cross-sectional view taken along the major axis of the half-elliptical cutter. FIG. 11C is a end view looking in the direction of the major axis of the half-elliptical cutter. This cutter is referred to as a half-elliptical cutter because only half of the elliptical shape along the major axis is included (in essence, half of the cutter shown in FIGS. 7A-7C). The concavity present on the face of the cutter 30 is defined by a curved or parabolic shape oriented along each of the major axis and minor axis which results in the formation of spherical, elliptical paraboloid or ovoidal concavity associated with the included half. The concave cutter face accordingly presents a continuous curve along any selected orientation from end to end across the face. In a preferred but not exclusive implementation, the thickness of the diamond table 32 layer varies as a function of the concave shape cutter face. In this elliptical cutter, the diamond table 32 layer is thicker towards a curved perimeter of the cutter 20 at all locations along and about that curved perimeter edge. Thus, the diamond table 32 is thicker towards a perimeter of the cutter 30 at the end 38 (along the major axis) as well as being thicker at the opposed ends 54 and 56 (along the minor axis), while being thinner towards a center 40' at the cut-off flat edge of the cutter 30 along the minor axis. The cutter is installed in the structure shown in FIG. 4 with its major axis and end 38 oriented toward the formation to be drilled. The concavity presents a first counter angle $c_1$ in the direction of the major axis, and a second counter angle $c_2$ in the direction of the minor axis. These counter angles need not be equal to each other.

Figure 12A:
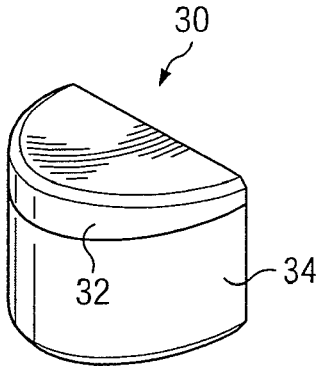
FIGS. 12A and 12B show a perspective view and a side view, respectively, for a half-elliptical cutter having a concave shape cutter face.
Figure 12B:
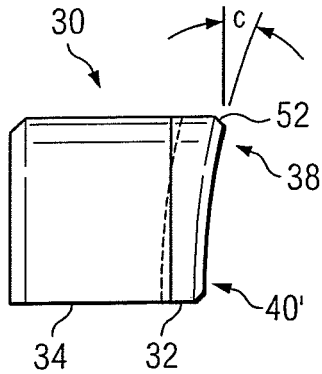

FIGS. 12A and 12B illustrate a half-elliptical cutter having a major axis and a minor axis. FIG. 12B is a side view of the half-elliptical cutter taken along the major axis. This cutter is referred to as a half-elliptical cutter because only half of the elliptical shape along the major axis is included (in essence, half of the cutter shown in FIGS. 5A-5B). The concavity present on the face of the cutter 30 is defined by a curved or parabolic shape oriented along the major axis extending from center 40' to end 38 to form a parabolic (or hyperbolic paraboloid) concavity. The concave cutter face presents a continuous curve from center 40' to end 38 along the major axis. In a preferred but not exclusive implementation, the thickness of the diamond table 32 layer varies as a function of the concave shape cutter face. In this elliptical cutter, the diamond table 32 layer is thicker towards a perimeter of the cutter 30 at the end 38 (along the major axis), while being thinner towards a center 40' of the cutter 30 at the flat edge of the cutter where the half section is defined. The cutter is installed in the structure shown in FIG. 4 with its major axis and end 38 oriented toward the formation to be drilled. The concavity on the face presents a counter angle c in the direction of the major axis.

Figure 13A:
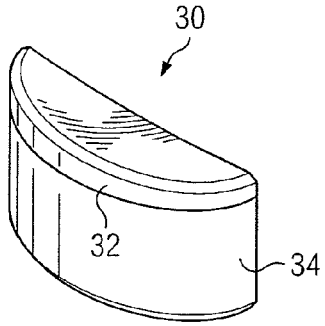
FIGS. 13A and 13B show a perspective view and a side view, respectively, for a half-elliptical cutter having a concave shape cutter face.
Figure 13B:
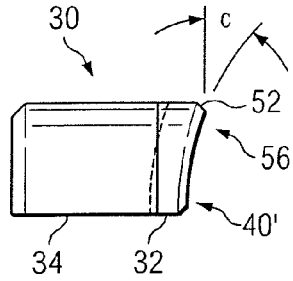

FIGS. 13A and 13B illustrate a half-elliptical cutter having a major axis and a minor axis. FIG. 13B is a side view of the half-elliptical cutter taken along the minor axis. This cutter is referred to as a half-elliptical cutter because only half of the elliptical shape along the minor axis is included (in essence, half of the cutter shown in FIGS. 6A-6B). The concavity present on the face of the cutter 30 is defined by a curved or parabolic shape oriented along the minor axis extending from center 40' to end 56 to form a parabolic (or hyperbolic paraboloid) concavity. The concave cutter face presents a continuous curve from center 40' to end 56 along the major axis. In a preferred but not exclusive implementation, the thickness of the diamond table 32 layer varies as a function of the concave shape cutter face. In this elliptical cutter, the diamond table 32 layer is thicker towards a perimeter of the cutter 30 at the end 56 (along the minor axis), while being thinner towards a center 40' of the cutter 30 at the flat edge of the cutter where the half section is defined. The cutter is installed in the structure shown in FIG. 4 with its minor axis and end 56 oriented toward the formation to be drilled. The concavity on the face presents a counter angle c in the direction of the minor axis.

Figure 14A:
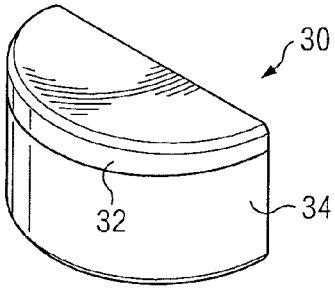
FIGS. 14A and 14B show a perspective view and a side view, respectively, for a half-round cutter having a concave shape cutter face.
Figure 14B:
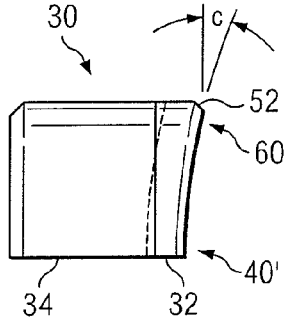

FIGS. 14A and 14B illustrate a half-round cutter having a first axis and a second, orthogonal, axis. FIG. 14B is a side view of the half-round cutter taken along the first axis. This cutter is referred to as a half-round cutter because only half of the round shape along the first axis is included (in essence, half of the cutter shown in FIGS. 8A-8B). The concavity present on the face of the cutter 30 is defined by a curved or parabolic shape oriented along the first axis extending from center 40' to end 60 to form a parabolic (or hyperbolic paraboloid) concavity. The concave cutter face presents a continuous curve from center 40' to end 60 along the first axis. In a preferred but not exclusive implementation, the thickness of the diamond table 32 layer varies as a function of the concave shape cutter face. In this elliptical cutter, the diamond table 32 layer is thicker towards a perimeter of the cutter 30 at the end 60 (along the first axis), while being thinner towards a center 40' of the cutter 30 at the flat edge of the cutter where the half section is defined. The cutter is installed in the structure shown in FIG. 4 with its first axis and end 60 oriented toward the formation to be drilled. The concavity on the face presents a counter angle c in the direction of the first axis.

Figure 15A:
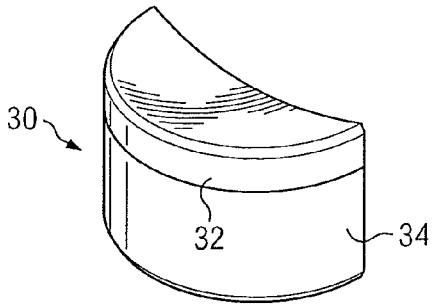
FIGS. 15A, 15B and 15C show a perspective view, a cross-sectional view and an end view, respectively, for a half-round cutter having a concave shape cutter face.
Figure 15B:
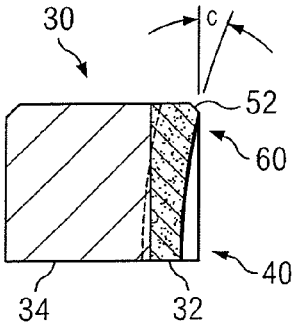
Figure 15C:
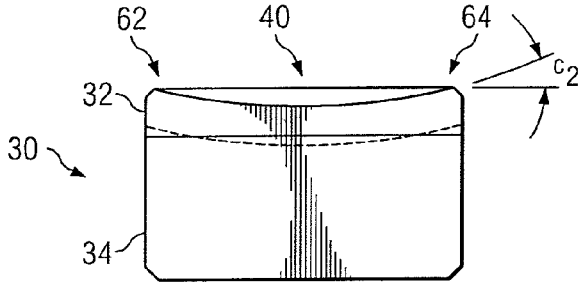

FIGS. 15A, 15B and 15C illustrate a half-round cutter having a first axis and a second, orthogonal, axis. FIG. 15B is a cross-sectional view taken along the first axis of the half-round cutter. FIG. 15C is a end view looking in the direction of the first axis of the half-round cutter. This cutter is referred to as a half-round cutter because only half of the round shape along the first axis is included (in essence, half of the cutter shown in FIGS. 9A-9C). The concavity present on the face of the cutter 30 is defined by a curved or parabolic shape oriented along each of the first and second axes which results in the formation of spherical, elliptical paraboloid or ovoidal concavity associated with the included half. The concave cutter face accordingly presents a continuous curve along any selected orientation from end to end across the face. In a preferred but not exclusive implementation, the thickness of the diamond table 32 layer varies as a function of the concave shape cutter face. In this half-round cutter, the diamond table 32 layer is thicker towards a curved perimeter of the cutter 30 at all locations along and about that curved perimeter edge. Thus, it is thicker towards a perimeter of the cutter 30 at the end 60 (along the first axis) as well as being thicker at the opposed ends 62 and 64 (along the second, orthogonal, axis), while being thinner towards a center 40' of the cutter 30 along the second axis. The cutter is installed in the structure shown in FIG. 4 with its first axis and end 60 oriented toward the formation to be drilled. The concavity presents a first counter angle $c_1$ in the direction of the first axis, and a second counter angle $c_2$ in the direction of the second axis. These counter angles need not be equal to each other.

Figure 16A:
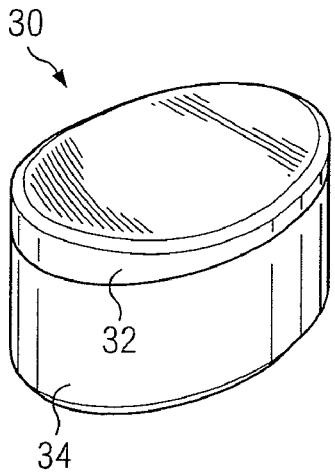
FIGS. 16A and 16B show a perspective view and side view, respectively, for an elliptical cutter having a concave shape cutter face.
Figure 16B:
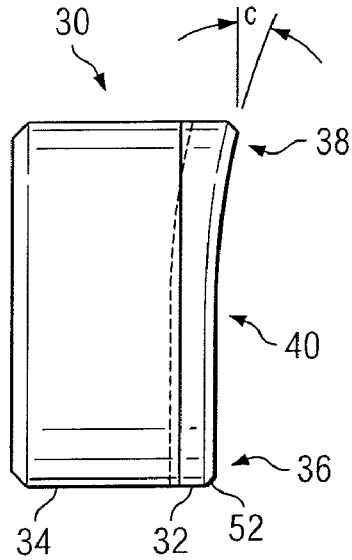

FIGS. 16A and 16B also illustrate an elliptical cutter having a major axis and a minor axis. FIG. 16B is a side view of the elliptical cutter taken along the major axis. The concavity present on the face of the cutter 30 is defined by a curved or parabolic shape oriented along the major axis extending from center 40 towards end 38 to form a parabolic (or hyperbolic paraboloid) concavity at that end and a planar surface at opposite end 36. The concave cutter face presents a continuous curve extending along the major axis from the flat surface associated with the end 36 and center 40 and terminating at the end 38. In a preferred but not exclusive implementation, the thickness of the diamond table 32 layer varies as a function of the concave shape cutter face. In this elliptical cutter, the diamond table 32 layer is thicker towards a perimeter of the cutter 20 at a first end 38 (along the major axis) and thinner towards a center 40 of the cutter 30 and at the second end 36 (along the major axis). More specifically, the diamond table 32 layer has a substantially constant thickness from the end 36 toward the center 40 along the major axis. The thickness of the diamond table 32 layer then increases from the center 40 towards the end 38 along the major axis. The cutter is installed in the structure shown in FIG. 4 with its major axis and end 38 oriented toward the formation to be drilled. The concavity on the face presents a counter angle c in the direction of the major axis.

Figure 17A:
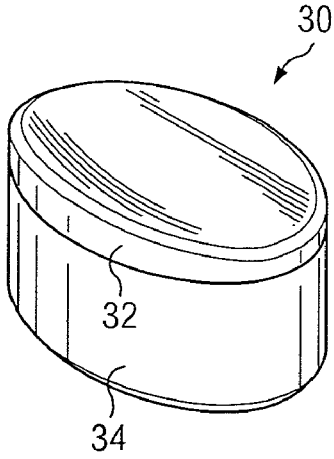
FIGS. 17A and 17B show a perspective view and side view, respectively, for an elliptical cutter having a concave shape cutter face.
Figure 17B:
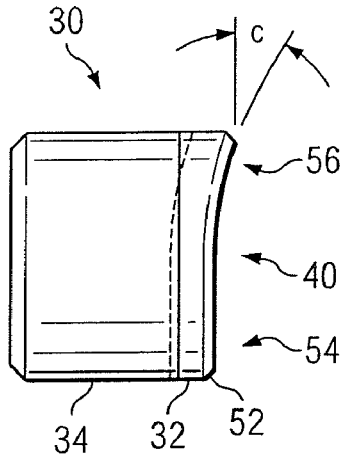

FIGS. 17A and 17B also illustrate an elliptical cutter having a major axis and a minor axis. FIG. 17B is a side view of the elliptical cutter taken along the minor axis. The concavity present on the face of the cutter 30 is defined by a curved or parabolic shape oriented along the minor axis extending from center 40 towards end 56 to form a parabolic (or hyperbolic paraboloid) concavity at that end and a planar surface at opposite end 54. The concave cutter face presents a continuous curve extending along the minor axis from the flat surface associated with the end 54 and center 40 and terminating at the end 56. In a preferred but not exclusive implementation, the thickness of the diamond table 32 layer varies as a function of the concave shape cutter face. In this elliptical cutter, the diamond table 32 layer is thicker towards a perimeter of the cutter 30 at the first end 56 (along the minor axis) and thinner towards a center 40 of the cutter 30 and the second end 54 (along the minor axis). More specifically, the diamond table 32 layer has a substantially constant thickness from the end 54 toward the center 40 along the minor axis. The thickness of the diamond table 32 layer then increases from the center 40 towards the end 56 along the minor axis. The cutter is installed in the structure shown in FIG. 4 with its minor axis and end 56 oriented toward the formation to be drilled. The concavity on the face presents a counter angle c in the direction of the minor axis.

Figure 18A:
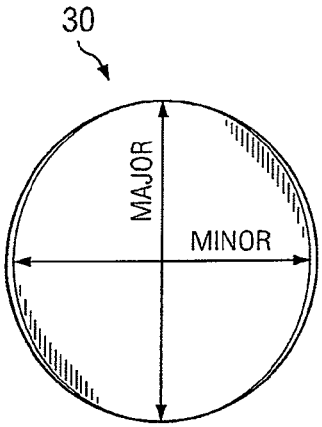
FIGS. 18A, 18B and 18C show a top view and two alternate side views, respectively, for an elliptical cutter having a concave shape cutter face.
Figure 18B:
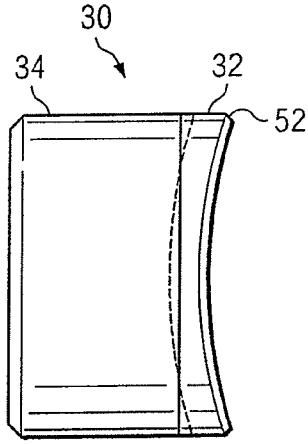
Figure 18C:
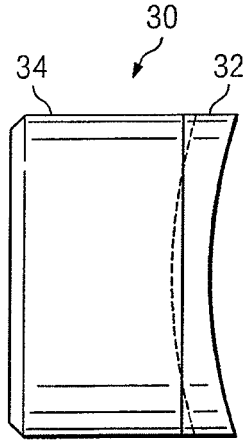

Reference is now made to FIGS. 18A, 18B and 18C which illustrate an elliptical cutter having a major axis and a minor axis. FIG. 18A is a top view which shows the major and minor axes. It will be noted that the sizes of the major and minor axis are illustrated to be almost identical, and when they are identical the cutter has a round configuration with the axes becoming first and second, orthogonal, axes, respectively. FIGS. 18B and 18C each show a side view of the cutter along the major axis. One difference between FIGS. 18B and 18C is that FIG. 18B shows the use of a chamfer 52 around the perimeter of the diamond table 32, while FIG. 18C does not include a chamfer. Thus, it will be recognized that the chamfer 52 at the perimeter edge of the diamond table 32 is an optional feature with respect to any of the cutters described herein.

Figure 19A:
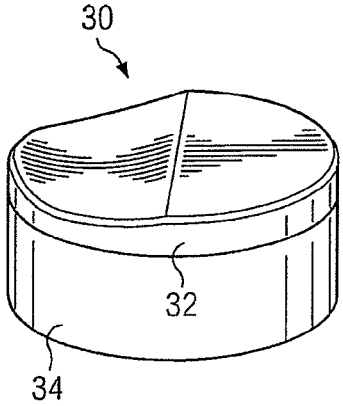
FIGS. 19A and 19B show a perspective view and side view, respectively, for an elliptical cutter having a concave shape cutter face.
Figure 19B:
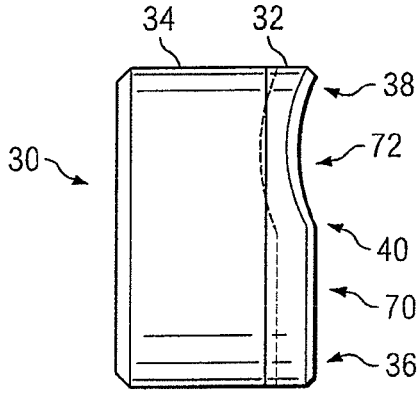

FIGS. 19A and 19B also illustrate an elliptical cutter having a major axis and a minor axis. FIG. 19B is a side view of the elliptical cutter taken along the major axis. In this implementation, there is again a concave cutter face configuration, but it is configured differently from those previously described. Along the major axis of the elliptical cutter, the face is divided into two halves. A first half 70 extends from the center 40 towards the end 36. A second half 72 extends from the center 40 towards the end 38. The concavity present on the face of the cutter 30 is defined in only the second half 72 by a curved or parabolic shape oriented along the major axis extending from center 40 towards end 38 to form a parabolic (or hyperbolic paraboloid) concavity in the second half 72, while the first half 70 presents a planar surface. The concave cutter face presents a continuous curve extending along the major axis from the center 40 and terminating at the end 38. In a preferred but not exclusive implementation, the thickness of the diamond table 32 layer in the first half 70 is substantially constant. However, the thickness of the diamond table 32 layer in the second half 72 varies as a function of the concave shape cutter face. With respect to the second half 72, the diamond table 32 layer is thicker towards the center 40 and a perimeter of the cutter 30 at the end 38 (along the major axis) while being thinner a points between the center 40 of the cutter 30 and the end 38 (along the minor axis). The thickness of the diamond table 32 in the first half 70 is generally equal to the maximum thickness of the diamond table in the second half 72. The cutter is installed in the structure shown in FIG. 4 with its major axis and end 38 oriented toward the formation to be drilled.

Figure 20A:
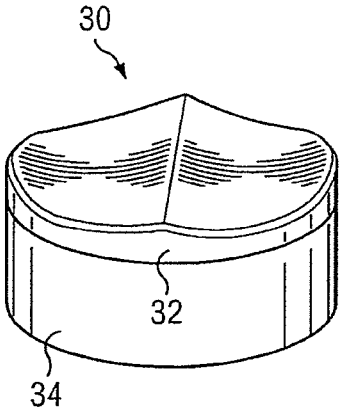
FIGS. 20A and 20B show a perspective view and side view, respectively, for an elliptical cutter having a concave shape cutter face.
Figure 20B:
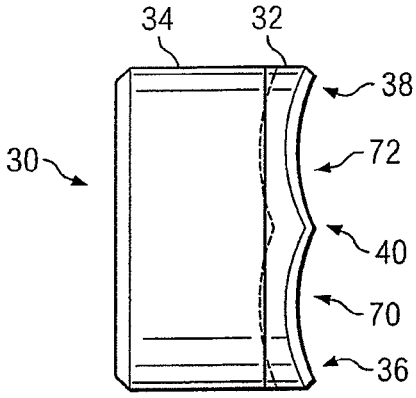

FIGS. 20A and 20B also illustrate an elliptical cutter having a major axis and a minor axis. FIG. 20B is a side view of the elliptical cutter taken along the major axis. In this implementation, there is again a concave cutter face configuration, but it is configured differently from those previously described. Along the major axis of the elliptical cutter, the face is divided into two halves. A first half 70 extends from the center 40 towards the end 36. A second half 72 extends from the center 40 towards the end 38. The concavity present on the face of the cutter 30 is defined such that each of the first half 70 and second half 72 presents a separate or distinct concave cutter shape defined by a curved or parabolic shape oriented along the major axis extending from center 40 towards either end 36 or 38 to form a distinct parabolic (or hyperbolic paraboloid) concavity in each of the first half 70 and second half 72. Each concave cutter face presents a continuous curve extending along the major axis from the center 40 and terminating at either end 36 or 38. In a preferred but not exclusive implementation, the thickness of the diamond table 32 layer in each of the first half 70 and second half 72 varies as a function of the concave shape cutter face. With respect to the first half 70, the diamond table 32 layer is thicker towards the center 40 and a perimeter of the cutter 30 at the end 36 (along the major axis) and thinner at points between the center 40 of the cutter 30 and the end 36 (along the minor axis). With respect to the second half 72, the diamond table 32 layer is thicker towards the center 40 and a perimeter of the cutter 30 at the end 38 (along the major axis) and thinner at points between the center 40 of the cutter 30 and the end 38 (along the minor axis). The cutter could be installed in the structure shown in FIG. 4 with its major axis and either end 36 or 38 oriented toward the formation to be drilled.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. Apparatus, comprising:

a cutter having:

a cemented tungsten carbide backing layer having an upper surface; and a diamond table layer bonded to the upper surface of the cemented tungsten carbide backing layer and defining a face of the cutter;

wherein a thickness of the diamond table layer varies across the face of the cutter to define a concave cutter face, the thickness being thinnest at a central region of the concave cutter face and thickest at a peripheral edge location of the concave cutter face, wherein a concave surface of said concave cutter face terminates at a formation cutting edge.

2. The apparatus of claim 1 wherein the cutter has one of a round or elliptical shape, and wherein the thickness is thickest at opposed first peripheral edge locations of the concave cutter face and the thickness is thinner at opposed second peripheral edge locations of the concave cutter face which are orthogonally positioned relative to the opposed first peripheral edge locations.

3. The apparatus of claim 1 wherein the cutter has one of a round or elliptical shape, and wherein the peripheral edge location where the thickness is thickest extends about the entire periphery of the round or elliptical shaped cutter.

4. The apparatus of claim 1 wherein the cutter has one of a round or elliptical shape, and wherein the thickness of the diamond table layer continuously decreases along a radial axis of the concave cutter face extending from the peripheral edge location where the layer is thickest to the central region where the layer is thinnest.

5. The apparatus of claim 1 wherein the cutter has one of a round or elliptical shape, and wherein the thickness of the diamond table layer continuously decreases along a first radial axis of the concave cutter face extending from the peripheral edge location where the layer is thickest to the central region where the layer is thinnest, and wherein the thickness of the diamond table layer is constant along a second radial axis of the concave cutter face extending to an edge of the cutter in a direction orthogonal to the first radial axis.

6. The apparatus of claim 5 wherein the cutter has the elliptical shape and the first radial axis a major axis of the ellipse and the second radial axis is a minor axis of the ellipse.

7. The apparatus of claim 1 wherein the thickness of the diamond table layer varies in a continuous curved manner.

8. The apparatus of claim 1 wherein the thickness is thickest at a first peripheral edge location and thinnest at a second peripheral edge location opposite the first peripheral edge location on the concave cutter face.

9. The apparatus of claim 1 wherein the thickness is thickest at a first peripheral edge location and thinnest at a second peripheral edge location opposite the first peripheral edge location on the concave cutter face, and wherein the thickness is thinnest at opposed third peripheral edge locations of the concave cutter face which are orthogonally positioned relative to the first and second peripheral edge locations.

10. The apparatus of claim 1 further comprising a curved peripheral edge of the cutter, and further comprising a chamfer formed in the curved peripheral edge, the chamfer having a depth which does not extend past the thickness of the diamond table layer, the chamfer meeting the concave cutter surface at the formation cutting edge.

11. The apparatus of claim 1 wherein the upper surface of the cemented tungsten carbide backing layer is flat and the diamond table layer is bonded to the flat upper surface of the cemented tungsten carbide backing layer.

12. The apparatus of claim 1 further comprising a drill bit body including a cutter pocket in which the cutter is mounted.

13. The apparatus as in claim 1, wherein the cutter has one of a half-round or half-elliptical shape defining a curved peripheral edge and a straight peripheral edge;

wherein the thickness of the diamond table layer is thinnest at about the central region along the straight peripheral edge of the concave cutter face and thickest at the peripheral edge location on the curved peripheral edge of the concave cutter face.

14. The apparatus of claim 13 wherein the thickness is thinnest along an entire length of the straight peripheral edge.

15. The apparatus of claim 13 wherein the peripheral edge location where the thickness is thickest extends about the entire curved peripheral edge.

16. The apparatus of claim 13 wherein the thickness of the diamond table layer continuously decreases along an axis of the concave cutter face extending from the peripheral edge location where the layer is thickest to the central region where the layer is thinnest.

17. The apparatus of claim 13 wherein the thickness of the diamond table layer continuously decreases along an axis of the concave cutter face perpendicular to the straight peripheral edge, and wherein the thickness of the diamond table layer is constant along the straight peripheral edge.

18. The apparatus of claim 13 further comprising a chamfer formed in the curved peripheral edge, the chamfer having a depth which does not extend past the thickness of the diamond table layer.

19. The apparatus of claim 13 further comprising a chamfer formed in the straight peripheral edge, the chamfer having a depth which does not extend past the thickness of the diamond table layer.

20. The apparatus of claim 13 wherein the cutter has the half-elliptical shape, wherein the thickness of the diamond table layer continuously decreases from the peripheral edge location along a major axis of the half-ellipse, the straight peripheral edge defining a minor axis of the half-ellipse.

21. The apparatus of claim 20 wherein the thickness of the diamond table layer continuously decreases from the curved peripheral edge along the minor axis of the half-ellipse.

22. The apparatus of claim 13 wherein the cutter has the half-elliptical shape, wherein the thickness of the diamond table layer continuously decreases from the peripheral edge location along a minor axis of the half-ellipse, the straight peripheral edge defining a major axis of the half-ellipse.

23. The apparatus of claim 22 wherein the thickness of the diamond table layer continuously decreases from the curved peripheral edge along the major axis of the half-ellipse.

24. The apparatus of claim 13 wherein the upper surface of the cemented tungsten carbide backing layer is flat and the diamond table layer is bonded to the flat upper surface of the cemented tungsten carbide backing layer.

25. The apparatus of claim 13 further comprising a drill bit body including a cutter pocket in which the cutter is mounted.

26. Apparatus, comprising:

a cutter, having:

a cemented tungsten carbide backing layer; and a diamond table layer bonded to the cemented tungsten carbide backing layer, wherein a thickness of the diamond table layer decreases from thicker at a peripheral edge of the diamond table layer to thinner at a central region of the diamond table layer, with the decreasing thickness defining a paraboloid front surface concavity for the cutter, wherein a concave surface of said paraboloid front surface concavity terminates at a formation cutting edge.

27. The apparatus of claim 26 wherein the paraboloid front surface concavity is defined by a continuously curved surface.

28. The apparatus of claim 26 wherein the cutter has a round shape and the paraboloid front surface concavity follows a first axis of the cutter round shape.

29. The apparatus of claim 28 wherein the paraboloid front surface concavity also follows a second axis of the cutter round shape which is perpendicular to the first axis.

30. The apparatus of claim 28 wherein round cutter shape is a half-round shape.

31. The apparatus of claim 26 wherein the cutter has an elliptical shape and the paraboloid front surface concavity follows one of a major or minor axis of the elliptical round shape.

32. The apparatus of claim 31 wherein the elliptical shape is a half-elliptical shape.

33. The apparatus of claim 26 wherein the cutter has an elliptical shape and the paraboloid front surface concavity follows both of a major and minor axis of the elliptical round shape.

34. The apparatus of claim 33 wherein the elliptical shape is a half-elliptical shape.

35. The apparatus of claim 26 wherein the paraboloid front surface concavity comprises a first portion of a face of the cutter, and wherein a thickness of the diamond table layer in a second portion of the face of the cutter is substantially constant.

36. The apparatus of claim 26 wherein the paraboloid concavity is a spherical cavity.

37. The apparatus of claim 26 wherein the paraboloid concavity is an elliptical paraboloid cavity.

38. The apparatus of claim 26 further comprising a drill bit body including a cutter pocket in which the cutter is mounted.

39. The apparatus of claim 38 wherein the paraboloid front surface concavity defines a variable back rake angle as a function of depth of cut.

40. The apparatus of claim 39 wherein the variable back rake angle as a function of depth of cut extends from a positive angle to a negative angle.

41. The apparatus of claim 38 wherein the backing layer, when the cutter is mounted in the cutter pocket, defines a relief angle, and wherein the back rake angle and relief angle are not equal to each other.

42. The apparatus of claim 26 further comprising a chamfer formed in the diamond table layer, the chamfer having a depth which does not extend past the thickness of the diamond table layer, the chamfer meeting the paraboloid front surface concavity at the formation cutting edge.

* * * * *